United States Patent [19]

Di Stefano et al.

[11] Patent Number: 4,793,527

[45] Date of Patent: Dec. 27, 1988

[54] AEROSOL DISPENSER

[76] Inventors: Alfonso Di Stefano, 1413 Wayburn Rd., Grosse Pointe Park, Mich. 48230; Gerald A. Farber, 23227 Clairwood, St. Clair Shores, Mich. 48080

[21] Appl. No.: 98,395

[22] Filed: Sep. 18, 1987

[51] Int. Cl.[4] ..... B65D 83/06

[52] U.S. Cl. ..... 222/402.24; 222/518

[58] Field of Search ..... 222/402.1, 402.11, 402.13, 222/402.12, 511, 518, 519, 549, 402.24, 464; 239/337

[56] References Cited

U.S. PATENT DOCUMENTS

| | | | |
|---|---|---|---|
| 233,117 | 10/1943 | Goodhue et al. . | |
| 3,115,277 | 12/1963 | Montague, Jr. | 222/518 X |
| 3,176,889 | 4/1965 | Potapenko et al. | 222/518 X |
| 3,731,854 | 5/1973 | Casey | 222/402.1 X |

*Primary Examiner*—Michael S. Huppert

*Attorney, Agent, or Firm*—Cullen, Sloman, Cantor, Grauer, Scott & Rutherford

[57] ABSTRACT

An aerosol dispenser has a housing adapted to hold an aerosol under pressure relative to a pressure outside of the housing. The housing has an interior chamber surrounded by interior walls and an opening to the outside. A stopper assembly is disposed within the housing and shaped to substantially conform to the shape of the housing. The stopper assembly is movable from a first position, in which the stopper assembly is substantially in contact with the interior walls of the housing so as to seal off any means of egress for the aerosol, from the interior chamber to the outside of the housing, to a second position, in which the stopper assembly is substantially out of contact with the interior walls so that at least one means of egress for the aerosol is established., At least one means of egress is traceable from the interior chamber to the opening to the outside.

9 Claims, 3 Drawing Sheets

AEROSOL DISPENSER

FIELD OF THE INVENTION

The present invention relates to spray dispensers and, more particularly, to dispensers for aerosols or gas products. Still more particularly, the present invention relates to aerosol spray dispensers filled with a product to be sprayed and a propellant gas under pressure.

BACKGROUND OF THE INVENTION

1. Terminology

A colloidal system, which consists of very finely divided liquid or solid particles dispersed in and surrounded by a gas, is called an "aerosol" when sprayed or dispensed into the atmosphere. The term "aerosol" is also used for the dispensers from which the liquid or solid particles are sprayed, propelled by a gas as a colloidal system, into the atmosphere. The term "aerosol" is to be used herein also to means gas, with or without dispersed products, sprayed into the atmosphere or dispsned from a container in accordance with a pressure differential.

2. Prior Art

It has been reported that the first U.S. patent for an aerosol dispenser was issued on Oct. 5, 1943, as U.S. Pat. No. 2,331,117 to L. D. Goodhue et al. The Goodhue et al. patent discloses a refillable dispenser designed to dispense a metered dose of a liquid product, which, when the dispenser is tipped, is held in a pocket from which a tube extends to a nozzle having a screw type operating valve. The liquid product contains a component volatile at ordinary room temperatures so as to produce a gas under sufficient pressure to expel the liquid from the pocket, through the tube, through the nozzle, and into the atmosphere when the valve is open. Goodhue et al. suggested components like dichlorodifluoromethane, carbon dioxide, and methylbromide. The expelled gas atmozies into the atmosphere.

3. Development of Technology

The technology of aerosol dispensing has moved forward since Goodhue et al., with advances in valve arrangements, propellants, and techniques for dispensing a wide variety of products such as hair spray, foam cleanser, toothpaste, and lacquer. The valve of a dispenser is now normally held shut by a coil spring directly below a valve stem and by the pressure within the product containing chamber of the dispenser. With this arrangement, a push button nozzle on the end of the valve stem may be pressed to force the valve stem down in its housing and to uncover a small passageway leading through the stem to the nozzle. The product is forced out through the passageway into the atmosphere.

Many propellants are now available for use with aerosols, propellants such as chlorinated hydrocarbons, propane, butane, vinyl chloride, and nitrogen. In addition to the two phase system disclosed in Goodhue et al., in which the propellant gas and the product to be discharged are separate layers within the dispenser, dispensers now contain the product to be dispensed and the propellant gas as a solution. The solution is developed by dissolving the product to be dispensed as an aerosol in alcohol so as to make it completely miscible with a liquid propellant. When the solution is exposed to the atmosphere, the propellant vaporizes to pressurize the dispenser chamber in which the liquid is contained, so as to force the liquid out of the dispenser into the atmosphere.

Different techniques are now used to produce different consistencies of aerosols. For example, to produce a fine mist, a propellant miscible with the product is used so that, as the solution leaves the nozzle, the propellant vaporizes to produce colloids of the product. By using a viscous solution and a relatively wide nozzle, a foam is produced. When a non-mixing product is forced through the tube by the pressure of the propellant within the chamber, a continuous stream of the product is produced.

PROBLEMS STILL UNRESOLVED

Despite the advancements made in the aerosol technology, one structural problem has been virtually unresolved since the structure conceived of by Goodhue et al. The Goodhue et al. aerosol dispenser structure consists of a nozzle, a valving arrangement, a chamber capable of holding a pressurized product, and a dip tube extending from the nozzle/valve to the chamber. These components are found in modern aerosol dispensers, and even as used in modern aerosol dispensers several problems are associated with the dip tube.

One problem with the dip tube is that it is prone to failure at its joint with the nozzle/valve. By one arrangement, the tube surrounds the valve stem. Often the kinetics of the valve stem moving up and down and the pressure within the dispenser causes the dip tube to dislodge, with the result that the dispenser becomes inoperative. Another problem is traceable to the other end of the dip tube being either in the middle of a convex bottom of the chamber, in which the product is housed, or to the side of the chamber. Consequently, there is always a remaining quantity of liquid product that is not reached by the tube, even when the dispenser is tipped to the side. Yet another problem is that the tube is prone to clogging up. This condition is not as much of a problem with regard to the nozzle, as the nozzle may be easily cleaned from the outside, for example, by sticking a pin into its opening or by running hot water over it. Finally, the most limiting problem associated with the dip tube is that it requires the dispenser to be used in a generally upright position. This is because the end of the dip tube may be exposed to the propellant without being exposed to the product, so that the propellant and not the product escapes into the atmosphere or the lower pressure zone.

OBJECTS OF THE INVENTION

Accordingly, it is an object of the present invention to provide an aerosol dispenser without the problems associated with the structural limitations of a dip tube.

It is another object of the invention to provide an aerosol dispenser that it is not prone to failure at the joint between the nozzle/valve and the passageway through which the product is dispensed from its disposition in the dispenser chamber to the nozzle/valve.

It is yet another object of the invention to provide a passageway for the product, from its disposition within the dispenser chamber to the nozzle/valve, regardless of the amount of the product remaining in the chamber or the orientation of the dispenser.

SUMMARY OF THE INVENTION

The above objects have been accomplished in the present invention by a dispenser that has a housing with an interior chamber adapted to hold an aerosol under a pressure relative to a pressure exterior to the housing. The genus of the preferred embodiment has a stopper assembly disposed within the housing. The stopper assembly is generally shaped to conform to the shape of the housing. The stopper assembly is movable from a first position in which a sealing member of the stopper assembly is substantially in contact with the interior wall, so as to seal off any means of egress for the aerosol from the dispenser, to a second position in which the sealing member of stopper assembly is substantially out of contact with the interior wall. At least one means of egress for the aerosol is established when the sealing member is out of contact with the interior wall. This means of egress is traceable from the interior chamber of the dispenser to the outside.

In a first specie, the housing is shaped by geometrical details including a top detail, which has more than half of a cylindrical wall and an open side opposite the more than half cylindrical wall. A flat, semicircular top end cap covers an upper end of the top detail. The housing also has a middle, collar detail, which has a full cylindrical wall. An upper end of the collar detail is integrally coincidental with a lower end of the top detail. The housing further has a bottom detail, which has a frustum shaped wall diverging from an open upper end, which is integrally coincidental with the open lower end of the collar detail, to a bottom lower end. The frustum shaped wall provides an interior chamber wall detail for the housing. Finally, the housing has a circular bottom end plate which has a convexity oriented toward the interior chamber.

In the housing, a portion of the stopper assembly with a nozzle opening extends through the open side of the top detail. This portion is a part of a neck or seal section through which at least one passageway communicates, at one end, with the interior chamber of the housing and, at the other end, with the nozzle opening. The neck or seal section has a side and a sealing member in intimate contact with a substantial portion of the walls of the top and middle details of the housing, so as to seal the interior chamber from the atmosphere, but the side and sealing member are out of contact with a remaining portion of the wall of the middle detail, so as to form an outer chamber between the neck or seal section and the middle detail of the housing. The at least one passageway is traceable from an opening on the side of the neck section, through the nozzle opening, and into the atmosphere. The stopper further has a conical section extending from the neck or seal section into the bottom frustum shaped, or truncated conical detail of the housing. This conical section is shaped to conform to the bottom truncated conical detail of the housing so as generally to surround the interior chamber and provide a stopper assembly interior chamber wall section.

With this structure, the stopper assembly is disposed within the housing so as to be movable from a biased, "off" position, in which the conical section is in conformed contact with the bottom detail of the housing, whereby the conical section closes off the interior chamber from the outer chamber. Also, the opening in the side of the neck or seal section is closed off from the outer chamber. From this position the stopper is movable to an "on" position, in which the hollow conical section is out of contact with the bottom detail of the housing so that both the interior chamber and the opening in the side of the seal are in communication with the outer chamber. When the stopper assembly is in this latter position, the pressurized aerosol is discharged from the interior chamber by flowing between the conical section of the stopper and the bottom detail of the housing, into the outer chamber, through the opening in the side of the neck or seal section, through at least one passageway, and out of the nozzle opening into the atmosphere. The stopper assembly is biased into its "off" position by an arrangement of the compression spring having one of its two ends bearing against a cross member extending across a bottom portion of the conical section and the other of its ends bearing against the bottom end plate of the housing.

In a second specie of the preferred embodiment of the invention, particularly adapted for use in dispensing a gas product, the same general elements of the genus are found. The dispenser has a housing adapted to hold an aerosol (gas) under pressure relative to a pressure outside of the housing. The housing has an interior chamber surrounded by interior walls and an opening to the outside. A stopper assembly is disposed within the housing and shaped to substantially conform to the shape of the housing. The stopper assembly is movable from a first position, in which the stopper assembly is substantially in contact with the interior walls of the housing so as to seal off any means of egress for the aerosol, from the interior chamber to the outside of the housing, to a second position in which the stopper assembly is substantially out of contact with the interior walls so that at least one means of egress for the aerosol is established. At least one means of egress is traceable from the interior chamber to the opening to the outside. An O-ring seal provides additional sealing to keep the gas in the interior chamber under pressure relative to the outside of the housing. The stopper assembly is placed into its "on" position, which is its second position, away from its biased "off" position, which is its first position, by being pushed from its first position into its second position upon receipt of a charging tube into the opening, which is adjacent a collar detail of the housing and the housing being pushed toward the discharge tube.

DETAILED DESCRIPTION OF THE INVENTION

Figure 1:
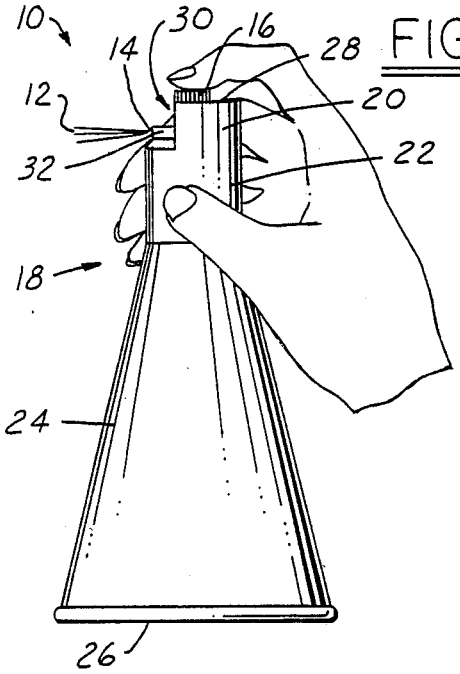
FIG. 1 is a side elevational view of the dispenser in use.

Referring to FIG. 1 of the drawings, a first specie of the preferred embodiment of the dispenser 10 of the present invention is shown in use to produce a spray 12 from a nozzle opening 14, when a finger presses a push button 16. In the embodiment as shown, an outer housing 18 of the dispenser 10 is a unitary structure that has three geometric details. A top detail 20 is more than half cylindrical. A middle, collar detail 22 is cylindrical. A bottom detail 24 is shaped as a frustum. Rigidly attached to the bottom detail 24 is a bottom plate 26, which, with a top end cap 28, complete the closure of the housing 18, except for an opening 30 opposite the more than half cylindrical wall of the top detail 20. The nozzle opening 14 is in a stopper assembly 32, which is within the housing 18.

Figure 2:
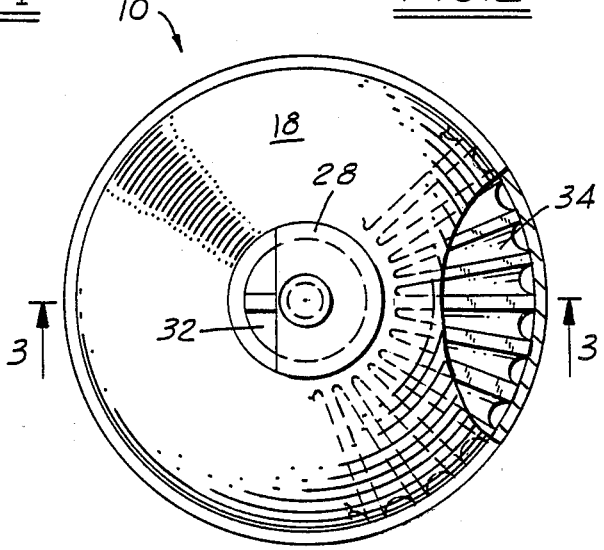
FIG. 2 is a top elevational view of the dispenser with a part of the outer housing of the dispenser cut away to show a portion of a stopper assembly with fluted sides.

Referring now to FIG. 2, the top end cap 28 can be seen to be a greater portion of a solid circular shape than would be a semicircular portion. From the vantage of the top elevational view shown by FIG. 2, the push button 16 is seen as atop the top end cap 28. Also from this vantage, a portion of the stopper assembly 32 is seen adjacent the top end cap 28. This portion of the stopper assembly 32 extends through the opening 30 and is represented by phantom lines to indicate that this portion extends beneath the top end cap 28.

Still referring to FIG. 2, a portion of the housing is cut away to reveal another portion of the stopper assembly 32. This latter portion of the seal assembly 32 is fluted with channels 34, which have a function that will be explained later.

Figure 3:
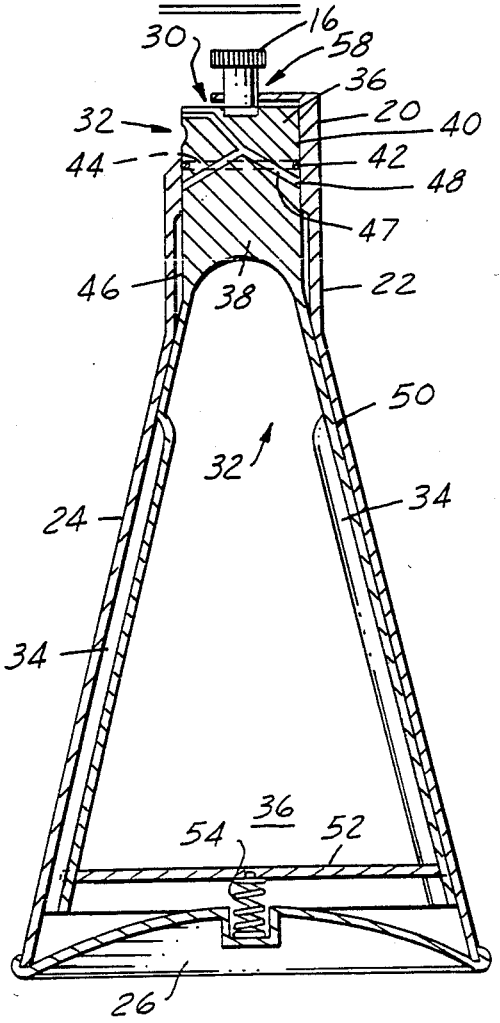
FIG. 3 is a cross-sectional view of the dispenser, taken along lines 3—3 of FIG. 2, with the dispenser in an "on" state.

Referring now to FIG. 3, the housing 18 is adapted to hold an aerosol under pressure relative to an atmosphere outside of the housing 18. The interior walls of the housing 18, which are the walls of the top detail 20, the middle detail 22, and the bottom detail 24, surround the interior of the housing 18. The aerosol is held under pressure in an interior chamber 36, for which the interior wall of the bottom detail 24 provides a housing interior chamber wall detail.

Previously, it was mentioned that the top detail 20 of the housing 18 is a more than half cylindrical wall and that opposite this wall is an opening 30 in the top detail 20. It can now be seen in FIG. 3 (and more clearly in FIG. 4 where the stopper assembly 32 is pushed down in the housing 18 to put the dispenser 10 in an "on" state as will be explained later) that the opening or the top open side 30 is bounded above by the top end cap 28.

Figure 4:
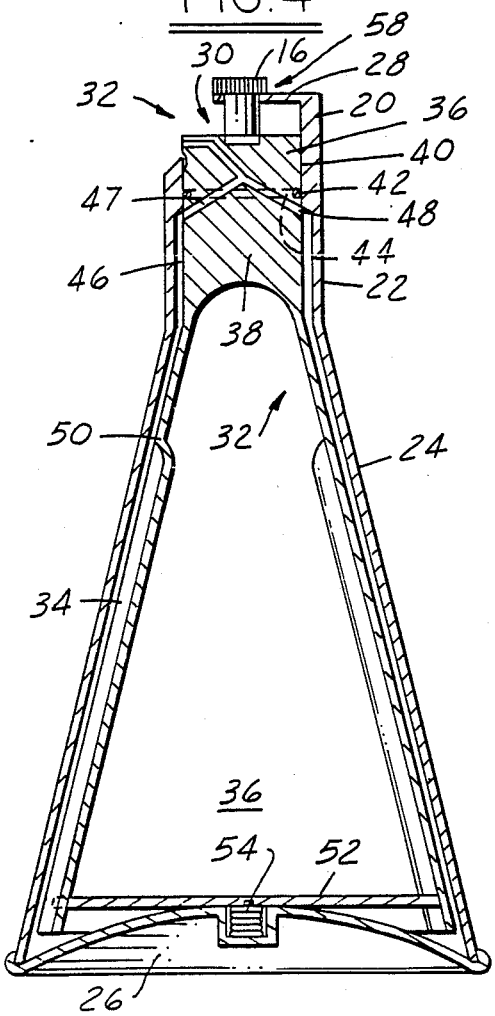
FIG. 4 is a cross-sectional view of the dispenser, taken along lines 3—3 of FIG. 2, with the dispenser in an "off" state.

Still referring to FIGS. 3 and 4, the middle detail 22 of the housing 18 is a cylindrical wall. An upper end of the middle detail 22 is integrally coincidental with the lower end of the top detail 20, and a lower end of the middle detail 22 is integrally coincidental with an upper end of the bottom detail 24.

The bottom detail 24 of the housing 18 is a frustum shaped wall diverging from the cylindrically shaped middle detail 22 at the upper end of the bottom detail 24 to a lower end of the bottom detail 24 on which the circular bottom end plate 26 is rigidly secured. The bottom end plate 26 is secured in a conventional manner for assuring a seal against the internal pressure within the housing 18; also, as a structural buttress against the internal pressure within the housing, the bottom end plate 26 has a convexity oriented toward the interior of the housing 18.

As was mentioned in reference to FIG. 1, the stopper assembly 32 is disposed within the housing 18. As can be seen in both FIGS. 1 and 2, the stopper assembly 32 extends through the open side 30 of the top detail 20 of the housing 18. This extension is a portion of a neck or seal section 38 in which the nozzle opening 14 communicates with the atmosphere external to the interior of the dispenser 10.

The seal section 38 has a side 40 in intimate contact with a substantial portion of a thickened portion of the wall of the middle detail 22 which extends from the wall of the top detail 20. This intimate contact seals the interior of the housing 18, particularly the interior chamber 36, from the atmosphere. Additionally, a sealing ring 42 is provided in a circumferential groove 44 in the neck or seal section 38. The sealing ring 42, as seated in the groove 44, is in contact with the thickened wall of the middle detail 20 to prevent leakage around the side 40 of the neck or seal section 38. The side 40 is out of contact with a remaining portion of the wall of the middle detail 22 of the housing 18, so as to form an outer chamber 46 between the stopper assembly 32 and the housing 18. This outer chamber 46 is restricted to a chamber surrounding the neck or seal section 38, when, as is illustrated in FIG. 3, the dispenser is in an "off" state, and extends into the bottom detail 24, when, as illustrated in FIG. 4, the dispenser is in an "on" state.

Although the preferred embodiment of the dispenser 10 is shown in FIG. 2 as having multiple branches of passageways 47 (the passageways may be distributed symmetrically to openings about the periphery of the neck or seal section 38), the seal section 38 has at least one passageway 47. The passageway 47 is traceable from at least one seal section opening 48 on the side 40 of the neck or seal section 38, through the seal section 38, into and through the nozzle opening 14, and then into the atmosphere.

The stopper assembly 32 also includes a frustrum shaped, conical section 50 that is shaped to conform to the frustrum shaped, truncated conical bottom detail 24 of the housing 18. As it is disposed within the bottom detail 24 so that it extends short of the bottom end plate 26, the conical section 50 of the stopper assembly 32 surrounds the interior chamber 36. The conical section 50 is the portion of the stopper assembly 32 discussed with reference to FIG. 2 as being fluted with channels 34. Each channel 34 of the fluted exterior of the conical section 50 functions as a dip tube that opens down into the liquid product. There are a plurality of channels 34 functioning as a plurality of dip tubes, therefore.

Proximate the bottom most extension of the conical section 50, a cross-member 52, which has each of its ends attached to the interior of the conical section 50 of the stopper assembly 32, extends diametrically across the interior chamber 36 of the housing 18. Depending from the center of the cross-member 52 is a compression spring 54 which is seated in a pocket 56 in the bottom end plate 26. One skilled in the art will appreciate that the compression spring 54 need not be attached to the cross-member 52 as shown in FIGS. 3 and 4, but need only bear against the bottom side of the cross-member 52 to bias the conical section 50 of the stopper assembly 32 against the interior walls of the bottom detail 24 of the housing 18.

Figure 5:
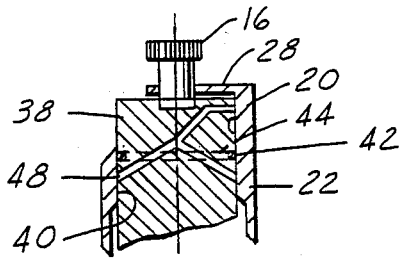
FIG. 5 is a partial view of the cross-sectional view of the dispenser shown in FIG. 3, but with the stopper assembly pivoted 180° as a safety device to close off a nozzle opening.
Figure 6:
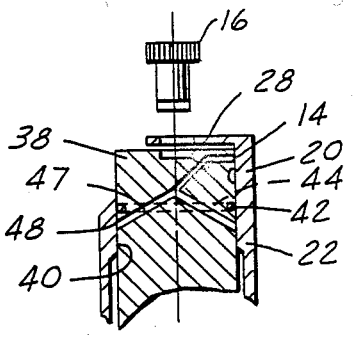
FIG. 6 is a partial cross-sectional view of the dispenser as shown in FIG. 5, but with the push button removed from the stopper-assembly as a further safety precaution.

FIGS. 5 and 6 show how the push button 16 may be twisted either clockwise or counterclockwise to rotate the neck or seal section 38 so that the nozzle opening 14 is oriented toward the more than half cylindrical wall of the top detail 20 of the housing 18. Thus oriented the dispenser is impeded from discharging the aerosol into the atmosphere. Accordingly, this feature operates as a safety mechanism against inadvertent discharge of the aerosol.

Figure 7:
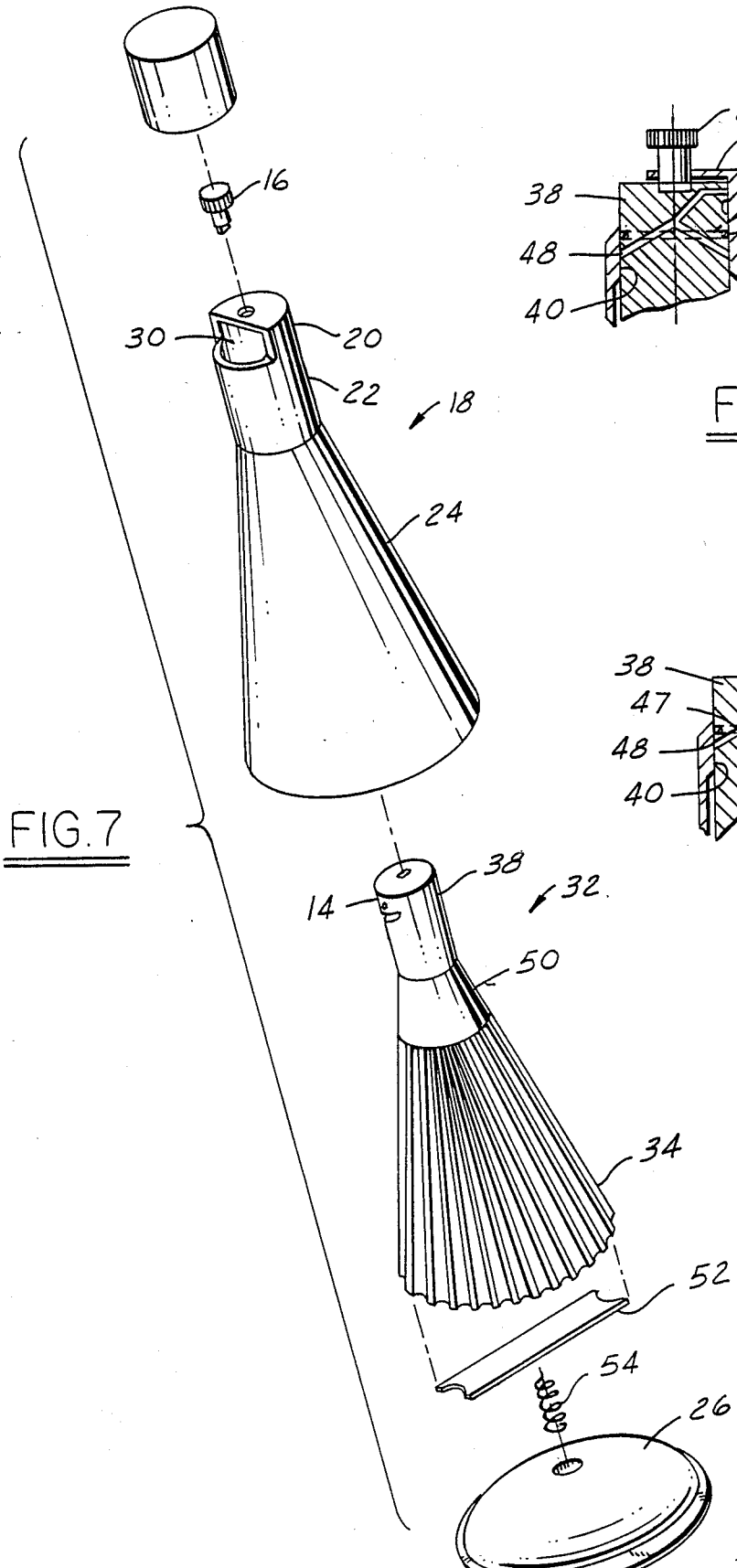
FIG. 7 is an exploded perspective view of the dispenser.

Cooperating with the safety feature, as is also illustrated in FIGS. 5 and 6, the pushbutton 16 is shown to be insertable (FIG.5) and removable from the stopper assembly 32 through the opening 58. When removed, the top detail 20 can be capped to allay any leakage of the aerosol contents. A cover cap is provided as shown in FIG. 7, which presents an overview of all of the features of the dispenser 10 described herein above.

The push button 16 is received, through an opening 58 in the top end cap 28, by the stopper assembly 32, which is disposed within the housing 18 so that the stopper assembly 32 is movable from a biased, "off" position, in which it is biased by the compression spring 54. In the "off" position, which is illustrated in FIG. 3 as when the dispenser 10 is in an "off" state, the conical section 48 is in conformed contact with the bottom detail 24 of the housing 18. Although the interior chamber 36 of the housing 18 communicates with the channels 34 on the exterior of the conical section 50, which face the interior wall of the bottom detail 24 of the housing 18, an upper side portion 60 of the conical section 50 closes off the interior chamber 36 from the outer chamber 46 and the opening 48 in the side of the neck or seal section 38 is closed off from the outer chamber 46 as the area around the opening 48 is in intimate contact with the interior wall of the middle, collar detail 22 of the housing 18.

In an "on" position, which is illustrated in FIG. 4 as when the dispenser 10 is in an "on" state brought about when the pushbutton 16 is pushed to force the stopper assembly 32 downwardly against the upwardly biasing force of the compression spring 54, the conical section 50 is out of contact with the bottom detail 24 of the housing 18, so that the interior chamber 36 is in communication with the extended outer chamber 46 and the opening 48 in the side of the seal section is in a position to communicate with the outer chamber 46. Thus, a means of egress is established for the pressurized aerosol to be discharged from the interior chamber 36 between an edge of the conical section 50 of the stopper assembly 32 and the end plate 26 of the housing 18, between the conical section of the stopper assembly 32 (which is the stopper assembly interior chamber wall when the dispenser is in an "off" state) and the bottom detail of the housing (which is the housing interior chamber wall) into the outer chamber 46 through the opening 48 in the side 40 of the seal section, through at least one passageway 47, and out of the nozzle opening 14 into the atmosphere.

Figure 8:
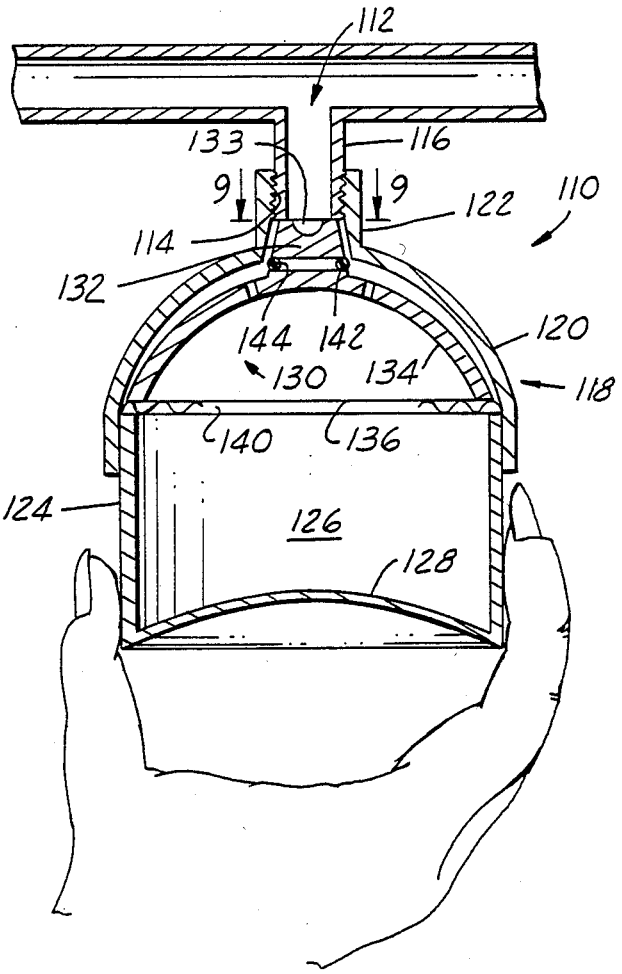
FIG. 8 is a sectional view of another specie of the preferred embodiment of the invention.

Another specie of the preferred embodiment of the invention, shown in FIG. 8, is used to dispense gas, for example, the freon that is used in a refrigeration system. In the embodiment as shown, a gas discharge 112 emerges through a threaded discharge opening 114 when the dispenser 110 is coupled with a matching threaded charging tube 116. The dispenser 110 may be so coupled by screwing the dispenser 110 into a threaded coupling relationship with the charging tube 116, whereby an end portion of the charging tube 116 is threadably received by the dispenser 110 through the threaded discharge opening 114.

Because this embodiment is particularly adapted to dispensing a gas product, reference is being made to the gas 112. It is to be appreciated, however, that all claims made to the dispensing of an aerosol include claims to the dispensing of a gas, as for instance, gas 112. Thus, as was discussed in the Terminology section of this specification, the term aerosol is used herein to be broadly applied to include a gas with or without suspended particles.

In the embodiment as shown, a housing 118 of the dispenser 110 is a bifurcated structure comprising a top housing member 120, 122 and a bottom housing member 124. The top housing member 120, 122 itself consists of two details. A hemispherical detail 120 particularly receives the bottom housing member 124 and forms a unitary structure therewith. A cylindrical collar detail 122, which is integral with the hemispherical detail 120, receives the charging tube 116 to form the threaded coupling relationship for discharging gas 112 through the discharge opening 114. To provide for the threaded coupling, a substantial portion of the interior wall of the collar detail 122 is threaded at the opening 14. The rest of the interior wall of the collar detail 122 is tapered radially outwardly from the threaded portion to the hemispherical detail 120. The bottom housing member 124 is cylindrically shaped with an upper and lower end and an interior chamber 126 that is opened at the upper end to the hemispherical detail 120 and is closed at the lower end by a bottom plate 128.

Still referring to FIG. 8, the housing 118 is adapted to hold gas 112 under a greater pressure relative to the pressure within the discharge tube 116. The interior wall of the housing 118, particularly the interior walls of the hemispherical detail 120 of the upper housing member and the bottom housing member 124, surround the interior chamber 126 and are joined together so as to withstand the pressure within the interior chamber 126. As with the first specie of the preferred embodiment, the bottom plate 128 has a convexity oriented toward the interior chamber 126 as a structural buttress against the internal pressure within the housing.

Disposed within the housing 118 is a stopper assembly 130. As can be seen in FIG.8, the stopper assemby 130 has a neck section 132 disposed generally within the collar detail 122 of the housing 118. A dome section 134 of the stopper assembly 130 is disposed generally within the hemispherical detail 120 of the housing 118 and shaped to conform thereto. Because the neck section 132 of the stopper assembly 130 is shaped to conform to the tapered interior wall of the collar detail 122, the neck section 132 is shaped as a frustum. As can be seen in FIG. 8, along with FIG. 9, a recess 133 atop the stopper assembly 130 has a semicircular cross-section. The recess 133 extends along the top stopper assembly 130 to the edges thereof immediately adjacent the tapered interior wall of the collar detail 122 of the housing 118.

Between the rim 136 of the dome section 134 and the rim 138 of the bottom housing member 124 are one or more annular springs 140, which bias the dome section 134 of the stopper assembly 130 upwards into intimate contact with the hemispherical detail 120 of the top housing member 120, 122. The stopper assembly includes an O-ring seal 142 located in a seating groove 144 around the neck section 132. When the dome section 134 is in intimate contact with the hemispherical detail 120, the O-ring seal 142 seals off the flow of pressurized gas 112 through the opening 114, including the flow through passage ways 144, which are holes in the dome section 134.

Figure 10:
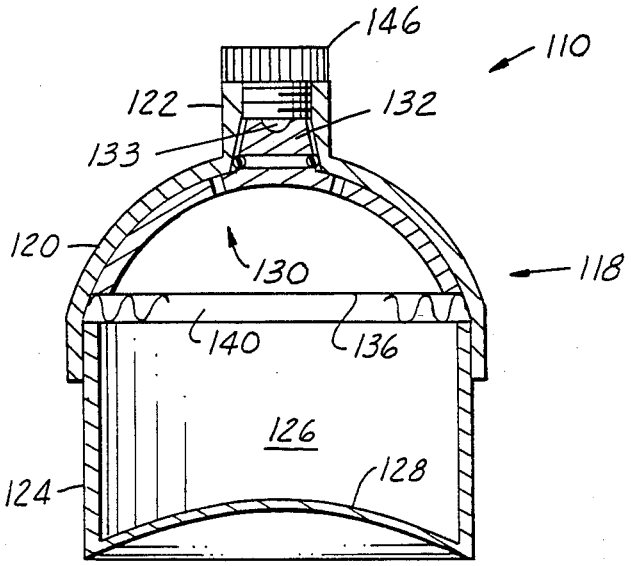
FIG. 10 is a sectional view of the embodiment shown in FIG. 8, in the orientation shown therein, the dispenser being capped for storage.

In FIG. 10, a threaded plug cap 146 is shown screwed onto the dispenser 110 when it is stored for a significant period of disuse, so as to provide a safety feature against an inadvertent dispensing of its contents, the risk of which will be apparent to those skilled in the art when the operation of the dispenser 110 is considered as will be disclosed.

Figure 9:
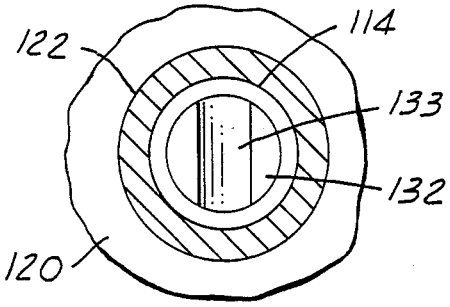
FIG. 9 is a partial top elevational view of the embodiment shown in FIG. 8, showing the opening into the housing thereof.

The embodiment shown in FIGS. 8–10 operates much in the manner of the embodiment shown in FIGS. 1–7. The stopper assembly 130 is disposed within the housing 118 so that the stopper assembly 130 is movable fron an "off" position, as shown in FIG. 10, into which it is biased by the annular springs 140. In the "off" position, the dome section 134 of the stopper assembly 130 is in conformed contact with the hemispherical detail 120 of the housing 118 and O-ring seal 142 is in sealing engagement with the tapered interior walls of the collar detail 122. The "off" position does not require that the cap plug 146 be threadably seated in the dispenser 110, as is shown in FIG. 10.

An "on" position, shown in FIG. 8, is attained when the dispenser 110 is screwed into the coupling arrangement with the charging tube 116 to force the stopper assembly 130 downwardly against the upwardly biasing force of the annular springs 140, the stopper assembly 130 is out of contact with the top housing member 120, 122, so that the O-ring seal 142 is no longer in sealing engagement with the tapered interior walls of the collar detail 122. This puts the interior chamber 126 in communication with a space between the hemispherical detail 120 and the dome section 134 of the stopper assembly 130 and the space between the neck section 132 and the collar detail 122. Specifically, this provides an egress for the gas product via passageways 144 and around the rim 136 of the dome section 134. Gas flowing along these routes eventually gains access to the charging tube 116 through the opening 114 and under the rim of the charging tube via the recess 133 atop the neck section 132 of the stopper assembly 130. Thus, the pressurized gas is discharged from the interior chamber 126 into the charging tube 116.

This invention may be further developed within the scope of the following claims. Accordingly, the above specifcation is to be interpreted as illustrated only one operative embodiment of the present invention, rather than in a strictly limited sense.

We claim:

1. A dispenser comprising:

a housing adapted to hold an aerosol under pressure relative to a pressure outside of the housing, the housing having a housing opening that opens to the outside and an interior chamber surrounded by an interior wall;

a stopper assembly shaped to substantially conform to the shape of the housing and disposed within the housing so that at least a portion of the stopper assembly is exposed to the outside through the housing opening, the stopper assembly having at least one opening through which the interior chamber is communicated to the outside and the stopper assembly being movable from a first position, in which the stopper assembly is substantially in contact with the interior wall so as to seal off the aerosol from the interior chamber to the outside of the housing, to a second position in which the stopper assembly is substantially out of contact with the interior wall thereby connecting the aerosol and the interior chamber to the outside of the housing through the stopper assembly opening;

said housing including a collar detail adjacent the opening that opens to the outside and the stopper assembly including a neck section generally disposed within the collar detail and sealing means to seal off the interior chamber from the outside of the housing when said stopper assembly is in said first position;

said sealing means being in intimate contact between the collar detail and the neck section of the stopper assembly when in said first position;

said housing including a housing interior chamber wall detail depending from the collar detail and the stopper assembly including a stopper assembly interior chamber wall section depending from the neck section, the stopper assembly interior chamber wall section having a rim with spring means disposed thereat, the spring means biasing the stopper assembly interior chamber wall section into confirmed contact with the housing interior chamber wall section; and said housing having a bottom plate and said spring means including a cross-member diametrically attached to the rim of the stopper assembly interior chamber wall section and a compression spring attached at one end to said cross-member and at the other end to the bottom plate of said housing.

2. The dispenser of claim 1, wherein said stopper assembly includes a sealing ring around the neck section and said sealing means is an intimate contact between the collar detail and the sealing ring.

3. The dispenser of claim 1, wherein said housing also includes a bottom member depending from the housing interior chamber wall detail, said bottom member having a rim exposed to the rim of the stopper assembly interior chamber wall section, and said spring means including at least one annular spring disposed between the rim of the bottom member and the rim of the stopper assembly.

4. The dispenser of claim 1, wherein both the housing interior chamber wall section and the stopper assembly interior chamber wall section are frustum shaped and the stopper assembly opening to the outside is through a nozzle opening in the neck section, the neck section extending through the housing opening.

5. The dispenser of claim 4, wherein the neck section has a push button extending therefrom and the stopper assembly is moved to the second position by a force exerted on the push button.

6. A dispenser comprising:

a housing having an interior chamber adapted to hold an aerosol under pressure relative to an atmosphere outside of the housing, the housing having a top detail including a top detail wall, an open side opposite the top detail wall, an open top lower end, and a top upper end, the housing also having a middle detail including a cylindrical wall, an open middle upper end integrally coincidental with the top lower end, and an open middle lower end, the housing further having a bottom detail including a truncated conical wall diverging from an open bottom upper end, which is integrally coincidental with the open middle lower end, to a bottom lower end, and the housing having a circular bottom end plate, the bottom end plate having a convexity oriented toward the interior chamber; and a stopper assembly having a seal section with a nozzle opening exposed to the outside of the housing through the open side of the top detail, the seal section having a side in intimate contact with a substantial portion of the wall of the top and middle details of the housing so as to seal the interior chamber from the atmosphere, the side being out of contact with a remaining portion of the wall of the middle detail of the housing so as to form an outer chamber between the seal section and the middle detail of the housing, and the seal section having at least one passageway traceable from a side opening on the side of the seal section through the nozzle opening and into the atmosphere, and the stopper assembly having a conical section extending from the seal section into the bottom truncated conical detail of the housing and being shaped to conform to the bottom truncated conical detail of the housing so as generally to surround the interior chamber, the stopper assembly being disposed within the housing so as to be movable from a biased, "off" position, in which the hollow conical section is in conformed contact with the bottom detail of the housing so as to close off the interior chamber from the outer chamber, while the opening in the side of the seal is coincidentally closed off from the outer chamber, to an "on" position, in which the hollow conical section is out of contact with the bottom detail of the housing so that the interior chamber is in communication with the outer chamber while the side opening is coincidentally in communication with the outer chamber, whereby the pressurized aerosol is discharged from the interior chamber, between the conical section of the stopper and the bottom detail of the housing, into the outer chamber, through the opening in the side of the seal, through at least one passageway, and out of the nozzle into the atmosphere.

7. The dispenser of claim 1, further comprising a push button attachable to and extending from the seal section for exerting a force against the seal section to move the stopper assembly to an "on" position.

8. The dispenser of claim 7, further comprising a flat top end cap covering the top upper end of the top detail of the housing, the top end cap having a push button opening for receiving the push button therethrough so that the push button is attachable to the seal section without obstruction from the top end cap.

9. A dispenser comprising:

a housing adapted to hold an aerosol under pressure relative to a pressure outside of the housing, the housing having an interior chamber surrounded by interior walls including a truncated conical wall in the bottom detail of the housing;

a stopper assembly disposed within the housing and shaped to substantially conform to the shape of the housing, the stopper assembly having at least one passageway traceable from at least one side opening in a side of the stopper assembly to a nozzle opening that is open to the atmosphere and the stopper assembly being movable from a first position in which at least a portion of the stopper assembly, including that portion of the stopper assembly surrounding the side opening, is generally in contact with a first measure of the surface of the interior walls so as to seal off the passageway from the interior chamber, to a second position in which at least that portion of the stopper assembly surrounding the side opening is generally out of contact with the first measure of the surface of the interior walls and the side opening is in communication with the interior chamber so that the interior is in communication with the atmosphere;

said housing also having a cylindrical collar detail and the stopper assembly having a seal section disposed within the collar detail, the at least one passageway and the at least one side opening in the side of the stopper assembly being in the seal section, so that the seal section completely seals off the interior chamber from the atmosphere when the stopper assembly is in the first position and the seal section seals off the interior chamber, except for communication via the passageway, when the stopper assembly is in the second position;

said stopper assembly also having a bottom section including a truncated conical wall conforming to the truncated conical wall of the housing, said bottom section being generally in contact with said bottom detail of the housing, when the stopper assembly is in the first position, and the bottom section being generally out of contact with said bottom detail of the housing and the interior chamber being in communication with the side opening of the stopper assembly, when the stopper assembly is in the second position;

an outer chamber located in the collar detail between at least one interior wall of the housing and the seal section of the stopper assembly;

said interior chamber being in communication with the side opening of the stopper assembly via the outer chamber, when the stopper assembly is in the second position;

means biasing the stopper assembly into the first position; and said means biasing the stopper assembly into the first position including a spring axially compressible in a direction from the first position to the second position, the spring being attached at one end to the housing and at the other end to a member connected to the bottom section of the stopper assembly.

* * * * *